US012163518B2

(12) United States Patent
Wood

(10) Patent No.: US 12,163,518 B2
(45) **Date of Patent: *Dec. 10, 2024**

(54) MULTISTAGE COMPRESSOR SYSTEM WITH INTERCOOLER

(71) Applicant: Mark W. Wood, Cedar Grove, TN (US)

(72) Inventor: Mark W. Wood, Cedar Grove, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/972,228

(22) Filed: Oct. 24, 2022

(65) Prior Publication Data

US 2023/0144667 A1 May 11, 2023

Related U.S. Application Data

(63) Continuation of application No. 16/780,371, filed on Feb. 3, 2020, now Pat. No. 11,480,178, which is a (Continued)

(51) Int. Cl.
*F04C 18/344* (2006.01)
*F04C 15/06* (2006.01)
(Continued)

(52) U.S. Cl.
CPC ..... *F04C 18/3441* (2013.01); *F04C 15/06* (2013.01); *F04C 18/3443* (2013.01);
(Continued)

(58) Field of Classification Search
CPC ..... F04C 18/3441; F04C 18/3443; F04C 11/001; F04C 15/06; F04C 23/001;
(Continued)

(56) References Cited

U.S. PATENT DOCUMENTS 1,872,361 A 8/1932 John et al.
2,545,238 A 3/1951 MacMillin et al.
(Continued)

FOREIGN PATENT DOCUMENTS

EP 1233186 A2 8/2002
EP 1233186 B1 9/2004
(Continued)

OTHER PUBLICATIONS

JP2008-116153A—Okaichi et al.—Refrigerating Cycle Device—May 22, 2008—the English Machine Translation. (Year: 2008).*
(Continued)

*Primary Examiner* — Theresa Trieu
(74) *Attorney, Agent, or Firm* — Kevin E. West; Advent, LLP

(57) ABSTRACT

A multistage compressor system with intercooler can include a sealed housing with first and second compressor stages, where the first compressor stage is for receiving refrigerant from outside of the sealed housing, and the second compressor stage is for receiving refrigerant from within the sealed housing. The compressor system can also include a crank for mechanically driving the first compressor stage and/or the second compressor stage, and a heat exchanger outside of the sealed housing for receiving refrigerant from the first compressor stage and exchanging heat with the refrigerant. The compressor system can further include an oil reservoir contained by the sealed housing, where the oil reservoir includes oil for lubricating the crank, receives the refrigerant from the heat exchanger, and exchanges heat with the refrigerant to cool the oil in the oil reservoir, and where the refrigerant can be supplied to the second compressor stage.

20 Claims, 13 Drawing Sheets

Related U.S. Application Data continuation-in-part of application No. 16/348,059, filed on May 7, 2019, now Pat. No. 11,339,786, and a continuation-in-part of application No. 16/044,106, filed as application No. PCT/US2016/060807 on Nov. 7, 2016, now Pat. No. 11,022,118, said application No. 16/044,106 is a continuation of application No. 15/139,608, filed on Apr. 27, 2016, now Pat. No. 10,030,658.

(51) Int. Cl.
*F04C 23/00* (2006.01)
*F04C 27/00* (2006.01)
*F04C 29/12* (2006.01)

(52) U.S. Cl.
CPC ..... *F04C 23/001* (2013.01); *F04C 27/001* (2013.01); *F04C 29/124* (2013.01)

(58) Field of Classification Search
CPC .... F04C 23/008; F04C 27/001; F04C 29/023; F04C 29/025; F04C 29/12; F04C 29/124; F04C 2240/603; F04C 2240/809
See application file for complete search history.

(56) References Cited

U.S. PATENT DOCUMENTS

| | | | |
|---|---|---|---|
| 2,966,898 | A | 1/1961 | Joseph et al. |
| 3,125,031 | A | 3/1964 | Rydberg et al. |
| 3,195,470 | A | 7/1965 | Smith |
| 3,410,478 | A | 11/1968 | Geisenhaver |
| 4,568,253 | A | 2/1986 | Wood |
| 4,629,403 | A | 12/1986 | Wood |
| 4,781,549 | A | 11/1988 | Caillat |
| 5,169,299 | A | 12/1992 | Gannaway |
| 5,222,885 | A | 6/1993 | Cooksey |
| 5,364,247 | A | 11/1994 | Fukanuma et al. |
| 5,399,076 | A | 3/1995 | Matsuda et al. |
| 5,501,584 | A | 3/1996 | Yamamoto et al. |
| 6,348,688 | B1 | 2/2002 | Vestal |
| 6,607,371 | B1 | 8/2003 | Raymond et al. |
| 6,746,223 | B2 | 6/2004 | Manole |
| 7,179,067 | B2 | 2/2007 | Bush et al. |
| 7,265,345 | B2 | 9/2007 | Hashimoto et al. |
| 7,341,437 | B2 | 3/2008 | Hwang et al. |
| 7,367,790 | B2 | 5/2008 | Hwang et al. |
| 7,378,650 | B2 | 5/2008 | Hashimoto et al. |
| 7,718,960 | B2 | 5/2010 | Hashimoto et al. |
| 8,517,702 | B2 | 8/2013 | Byun et al. |
| 8,879,064 | B2 | 11/2014 | O'Connor et al. |
| RE46,106 | E | 8/2016 | Seong et al. |
| 9,524,856 | B2 | 12/2016 | Hilliard et al. |
| 9,683,965 | B2 | 6/2017 | Clemmer et al. |
| 10,030,658 | B2 | 7/2018 | Wood |
| 11,022,118 | B2 | 6/2021 | Wood |
| 11,339,786 | B2 | 5/2022 | Wood |
| 11,480,178 | B2 * | 10/2022 | Wood ..... F04C 18/3441 |
| 11,686,309 | B2 | 6/2023 | Wood |
| 2001/0018028 | A1 | 8/2001 | Kikuchi et al. |
| 2002/0014586 | A1 | 2/2002 | Clemmer |
| 2002/0070338 | A1 | 6/2002 | Loboda |
| 2002/0070339 | A1 | 6/2002 | Clemmer |
| 2002/0102171 | A1 | 8/2002 | Jurgen et al. |
| 2003/0020012 | A1 | 1/2003 | Guevremont |
| 2006/0056988 | A1 | 3/2006 | Seok et al. |
| 2006/0071159 | A1 | 4/2006 | Hashimoto et al. |
| 2006/0073055 | A1 | 4/2006 | Hwang et al. |
| 2006/0210415 | A1 | 9/2006 | Ohtake |
| 2009/0013714 | A1 | 1/2009 | Yamaguchi et al. |
| 2010/0119378 | A1 | 5/2010 | Shibamoto et al. |
| 2010/0127164 | A1 | 5/2010 | Atkinson et al. |
| 2010/0230588 | A1 | 9/2010 | Atkinson et al. |
| 2010/0252731 | A1 | 10/2010 | Reilly |
| 2011/0133074 | A1 | 6/2011 | Nakanishi et al. |
| 2011/0165007 | A1 | 7/2011 | Pekrul |
| 2011/0198493 | A1 | 8/2011 | Clemmer et al. |
| 2012/0228491 | A1 | 9/2012 | Wu et al. |
| 2012/0326023 | A1 | 12/2012 | Kozole |
| 2013/0011290 | A1 | 1/2013 | Okamoto et al. |
| 2013/0292562 | A1 | 11/2013 | Clemmer et al. |
| 2014/0339417 | A1 | 11/2014 | Hendrikse |
| 2018/0047551 | A1 | 2/2018 | Jones et al. |
| 2020/0173438 | A1 | 6/2020 | Wood |

FOREIGN PATENT DOCUMENTS

| | | | |
|---|---|---|---|
| GB | 2234787 | A | 2/1991 |
| JP | 2005273453 | A | 10/2005 |
| JP | 2008116153 | A | 5/2008 |
| JP | 2013024806 | A | 2/2013 |
| KR | 20100084079 | A | 7/2010 |
| WO | 2015147744 | A1 | 10/2015 |

OTHER PUBLICATIONS

International Search Report and Written Opinion mailed May 30, 2017 for PCT/US2017/020162.

International Search Report and Written Opinion malled May 30, 2017 for PCT/US2017/020162.

International Preliminary Report on Patentability for PCT/US2017/020162, dated Oct. 30, 2018.

International Search Report and Written Opinion for Application No. PCT/US2016/060807, dated Jul. 25, 2017.

Lee, Jeong-Bae, et al., "Development of a Miniature Twin Rotary Compressor," 22nd International CompressorEngineering Conference at Purdue, Jul. 14-17, 2014 http://docs.lib .purdue.edu/cgi/viewcontent.cgi?article=3316context=icec).

PCT International Search Report and Written Opinion for PCT/US2021/016412, dated May 6, 2021.

* cited by examiner

MULTISTAGE COMPRESSOR SYSTEM WITH INTERCOOLER

The present application is a continuation under 35 U.S.C. § 120 of U.S. patent application Ser. No. 16/780,371, filed Feb. 3, 2020, and titled "MULTISTAGE COMPRESSOR SYSTEM WITH INTERCOOLER," which is a continuation-in-part under 35 U.S.C. § 120 of U.S. patent application Ser. No. 16/044,106, filed Jul. 24, 2018, and titled "CONCENTRIC VANE COMPRESSOR," which itself is a continuation under 35 U.S.C. § 120 of U.S. patent application Ser. No. 15/139,608, filed Apr. 27, 2016, titled "CONCENTRIC VANE COMPRESSOR," and now issued as U.S. Pat. No. 10,030,658. U.S. patent application Ser. No. 16/780,371 is also a continuation-in-part under 35 U.S.C. § 120 of U.S. patent application Ser. No. 16/348,059, filed May 7, 2019, and titled "SCROLL COMPRESSOR WITH CIRCULAR SURFACE TERMINATIONS." U.S. patent application Ser. No. 15/139,608, U.S. patent application Ser. No. 16/044,106, U.S. patent application Ser. No. 16/348,059, and U.S. patent application Ser. No. 16/780,371 are herein incorporated by reference in their entireties.

The present application is also a continuation-in-part of International Application No. PCT/US2016/060807, filed Nov. 7, 2016, and titled, "SCROLL COMPRESSOR WITH CIRCULAR SURFACE TERMINATIONS," which is herein incorporated by reference in its entirety.

BACKGROUND

A refrigerant compressor is a device that pressurizes refrigerant gas using power from a device such as an electric motor, a diesel engine, a gasoline engine, and so forth. During the compression process, the gas is heated naturally and routed to a condenser. The condenser cools the gas to a "sub cooled" liquid. The "sub cooled" liquid is routed through an expansion nozzle to an evaporator. The expanding liquid vaporizes in the evaporator and cools the evaporator before being routed to the intake port of the compressor to repeat the refrigeration process.

Vane compressors generally include a stationary or fixed cylinder with a slot for a reciprocating vane. An orbiting cylinder is positioned within the fixed cylinder, and the reciprocating vane (e.g., with a vane spring) is inserted into the vane slot on the outer fixed cylinder, with one end maintaining contact with the smaller orbiting cylinder. The vane provides a barrier between high and low pressure regions within a cylinder cavity formed between the stationary or fixed cylinder and the orbiting cylinder.

DRAWINGS

The Detailed Description is described with reference to the accompanying figures. The use of the same reference numbers in different instances in the description and the figures may indicate similar or identical items.

DETAILED DESCRIPTION

Figure 1:
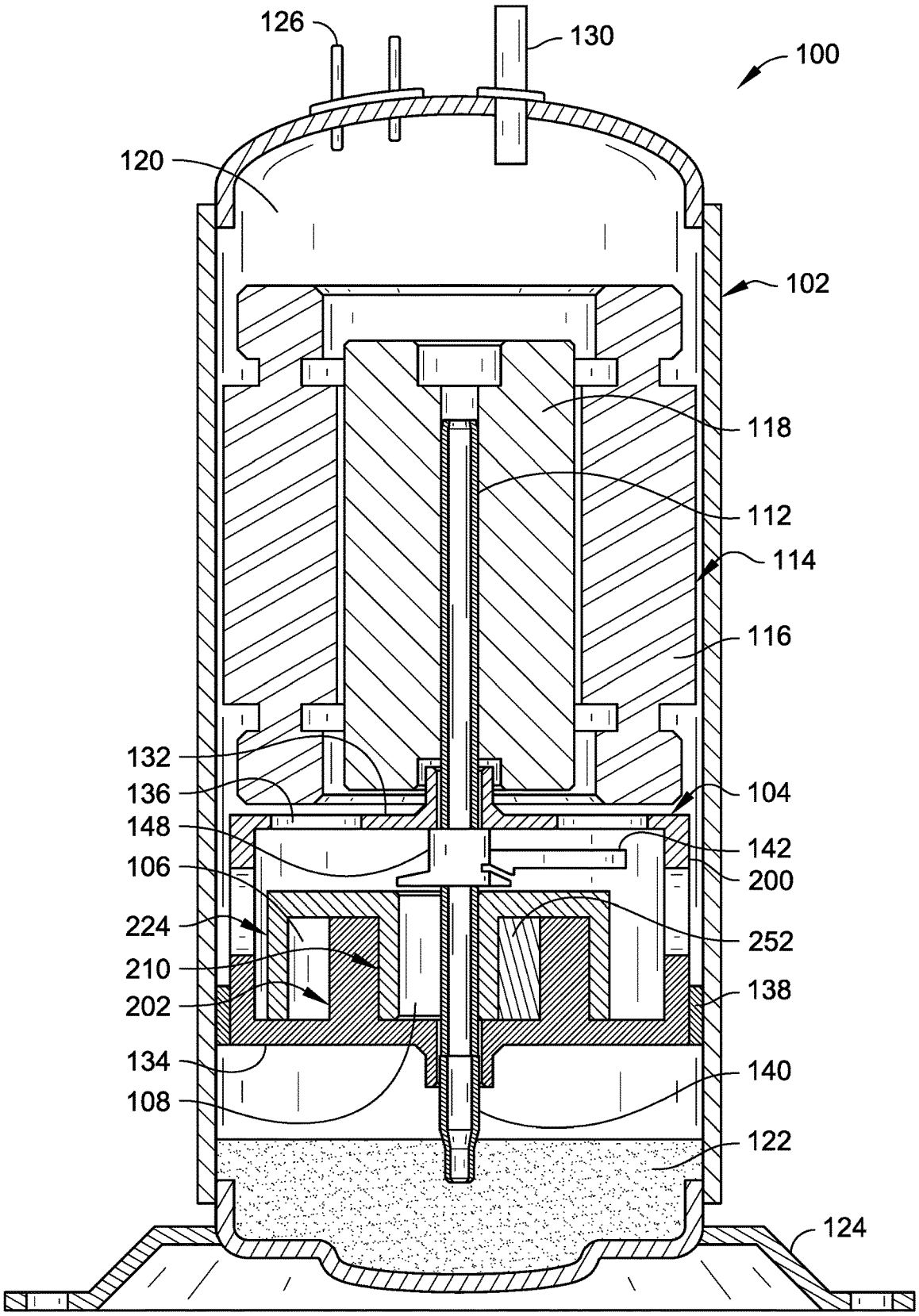
FIG. 1 is a cross-sectional side elevation view illustrating a multistage compressor system with a lower shaft bearing located at the bottom of a compressor and an upper shaft bearing located above a counterweight at the bottom of a motor in accordance with an example embodiment of the present disclosure.

Referring generally to FIGS. 1 through 19, compressor systems 100 are described. A multi-stage (e.g., two stage)

compressor system 100 (e.g., configured as an intercooler) can include a sealed housing 102 (e.g., a crankcase shell). The compressor system 100 can also include one or more positive displacement devices (e.g., compressors 104) having a first compressor stage 106 (e.g., a low pressure stage) and/or a second compressor stage 108 (e.g., a high pressure stage) contained by the sealed housing 102. As described, the first compressor stage 106 is configured for receiving refrigerant 110 or other fluid from outside of the sealed housing 102 and compressing the refrigerant 110. The second compressor stage 108 is configured for receiving refrigerant 110 or other fluid from within the sealed housing 102 and compressing the refrigerant 110. It should be noted that while two compressor stages are described herein, more than two compressor stages may be provided (e.g., three compressor stages or more than three compressor stages).

The refrigerant 110 supplied to the first compressor stage 106 from outside of the sealed housing 102 can be in a gaseous state when supplied to the first compressor stage 106 and can then be converted to a liquid state after exiting the first compressor stage 106. The refrigerant 110 supplied to the second compressor stage 108 from within the sealed housing 102 can be in a gaseous state when supplied to the second compressor stage 108. Thus, the refrigerant 110 can undergo a phase change from gas to liquid (after exiting the first compressor stage 106) and then back to gas (prior to the second compressor stage 108), enhancing thermal transfer within a compressor system 100.

In some embodiments, a compressor 104 can be a multi-stage compressor including two compression chambers, one larger (e.g., low pressure stage) and one smaller (e.g., high pressure stage), one hundred and eighty degrees (180°) out of phase. For example, the compressor system 100 includes a concentric vane compression device including both the first compressor stage 106 and the second compressor stage 108. In embodiments of the disclosure, a concentric vane compression device can be implemented as described in U.S. Pat. No. 10,030,658, titled "CONCENTRIC VANE COMPRESSOR," which is incorporated by reference herein. However, a compressor with two compression cavities is provided by way of example and is not meant to limit the present disclosure.

In some embodiments, more than one compressor 104 may be used to provide the first compressor stage 106 and the second compressor stage 108. For example, the compressor system 100 can include two or more spiral scroll compression devices forming the first compressor stage 106 and the second compressor stage 108. In embodiments of the disclosure, a spiral scroll compression device can be implemented as described in U.S. patent application Ser. No. 16/348,059, titled "SCROLL COMPRESSOR WITH CIRCULAR SURFACE TERMINATIONS," which is incorporated by reference herein. The compressor system 100 may also include two or more other types of compressors or other devices that increases the pressure of a gas by reducing its volume, including, but not necessarily limited to: reciprocating compressors, rotary screw compressors, rotary vane compressors, rolling piston compressors, diaphragm compressors, centrifugal compressors, axial compressors, and so forth.

The compressor 104 also includes at least one crank 112 (e.g., crankshaft) for mechanically driving compression in the first compressor stage 106 and/or the second compressor stage 108. In some embodiments, the crank 112 mechanically drives compression in both the first compressor stage 106 and the second compressor stage 108. For example, a motor 114 includes a stator 116 and a rotor 118 mechanically coupled with a concentric vane compression device by the crank 112 (e.g., as described with reference to FIGS. 1, 2, and 6 through 19). The motor 114 is thus connected to a common crankshaft that drives compression in two differently sized compression cavities (e.g., the first compressor stage 106 and the second compressor stage 108). In some embodiments, each compressor 104 has its own crank 112. For example, a first compressor 104 forming a first compressor stage 106 has a first crank 112, and a second compressor 104 forming a second compressor stage 108 has a second crank 112. In this example, each of the two cranks 112 can be connected to a separate motor 114. For instance, two motors 114 can each be mechanically coupled with a separate respective spiral scroll compression device by a separate crank 112.

The compressor system 100 can also include an interior cavity 120 for containing refrigerant 110 and/or other fluid (e.g., air) from the surrounding environment and oil 122 (e.g., in an oil reservoir or bottom portion of the interior cavity 120). The sealed housing 102 may be supported by a base plate 124 or other supporting structure. One or more electrical terminals 126 can be connected through the sealed housing 102 to wiring used to supply electrical power to the motor 114 and/or to other components of the compressor system 100. One or more suction pipes 128 can be used to supply the refrigerant 110 or other fluid to the first and second compressor stages 106 and 108, and one or more discharge pipes 130 can be used to supply the compressed refrigerant 110 or other fluid from the compressor system 100.

The compressor system 100 can include a first bearing 132 (e.g., a main bearing) and a second bearing 134 (e.g., a sub-bearing). Together, the first bearing 132 and the second bearing 134 can constrain motion of the crank 112 and reduce friction between the crank 112 and other components of the compressor system 100. In some embodiments, the first bearing 132 is outside of and adjacent to the motor 114, e.g., as described with reference to FIG. 1, where the motor 114 can be pressed into, for instance, a hermetic housing, and the compressor 104 is constrained between the first and second bearings 132 and 134. In some embodiments, the first bearing 132 is configured as a top bearing bracket, e.g., as described with reference to FIG. 2, with the motor 114 and the compressor 104 constrained between the first and second bearings 132 and 134. In embodiments of the disclosure, the first bearing 132 and/or the second bearing 134 can include one or more vent holes 136. Mounting pads 138 may extend radially outward from, for example, a flange of the compressor 104 to an inside surface of the sealed housing 102 to constrain the compressor 104 and/or the motor 114.

In some embodiments, the crank 112 can be a hollow shaft, and may include an oil pump 140, e.g., a centrifugal oil pump with another hollow shaft or a portion of the same crank disposed at one end of the crankshaft and extending into the oil 122 contained in the oil reservoir or bottom portion of the interior cavity 120. The oil pump 140 can be used to draw the oil 122 into an interior of the crank 112 and then up the crankshaft, where the oil 122 is expelled and sprayed over various components of the compressor 104. For instance, the crank 112 and/or oil pump 140 can include holes or other apertures along its length, and the oil 122 can be expelled from the interior of the crank 112 through the holes. As described herein, the oil 122 can be used to cool both the refrigerant 110 and various compressor components in addition to lubricating various compressor components.

It will be appreciated that the diameter of the crank 112 and/or the oil pump 140, as well as the number of holes or apertures and their arrangement along the crank 112 and/or the oil pump 140 may be varied to pump different volumes of oil at different rates. For example, a larger diameter crank 112 may be used to pump more oil than a comparatively smaller crank (e.g., more oil over time, more oil by volume, etc.). It should be noted that the centrifugal oil pump 140 described herein is provided by way of example only and is not meant to limit the present disclosure. In other embodiments, an oil pump 140 may be a gear-driven oil pump, an oil pump with paddles (e.g., elastomeric/rubber paddles), and/or another type of oil pump.

Figure 13:
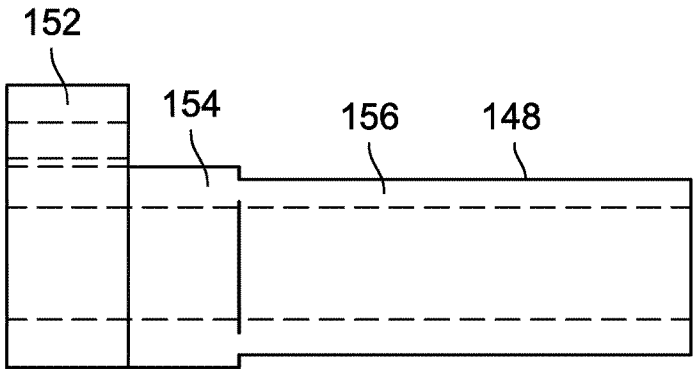
FIG. 13 is a side view illustrating a thrust bearing for a concentric vane compressor, such as the concentric vane compressor shown in FIG. 6, in accordance with an example embodiment of the present disclosure.
Figure 15:
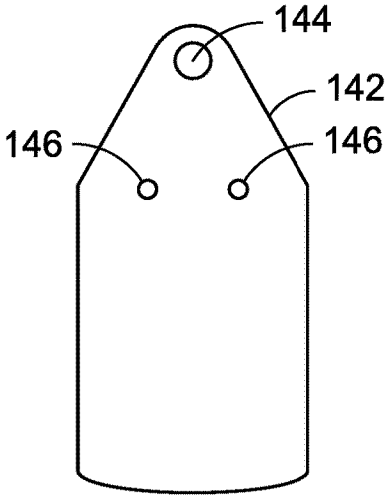
FIG. 15 is an end view illustrating a counterweight for a concentric vane compressor, such as the concentric vane compressor shown in FIG. 6, in accordance with an example embodiment of the present disclosure.
Figure 14:
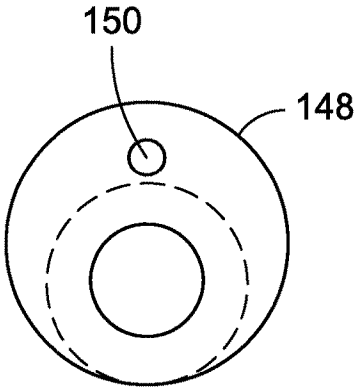
FIG. 14 is an end view of the thrust bearing illustrated in FIG. 13.

The compressor systems 100 may also include one or more counterweights, thrust bearings, and/or oil slingers. For example, a counterweight 142 may be fixedly coupled with the crank 112 and, in addition to providing weighted balance to the compressor 104, may act as an oil slinger. In this manner, the counterweight 142 can facilitate the dispersal/spray of cooling oil, e.g., over a top surface of the compressor 104. With reference to FIGS. 13 through 15, in some embodiments the counterweight 142 can include a mounting bolt hole 144 and alignment posts 146. The counterweight 142 may be bolted to a lower thrust bearing 148 at a threaded mounting bolt hole 150, e.g., with a bolt inserted through the mounting bolt hole 144 of the counterweight 142 and fastened to the threaded mounting bolt hole 150 of the thrust bearing 148.

Figure 2:
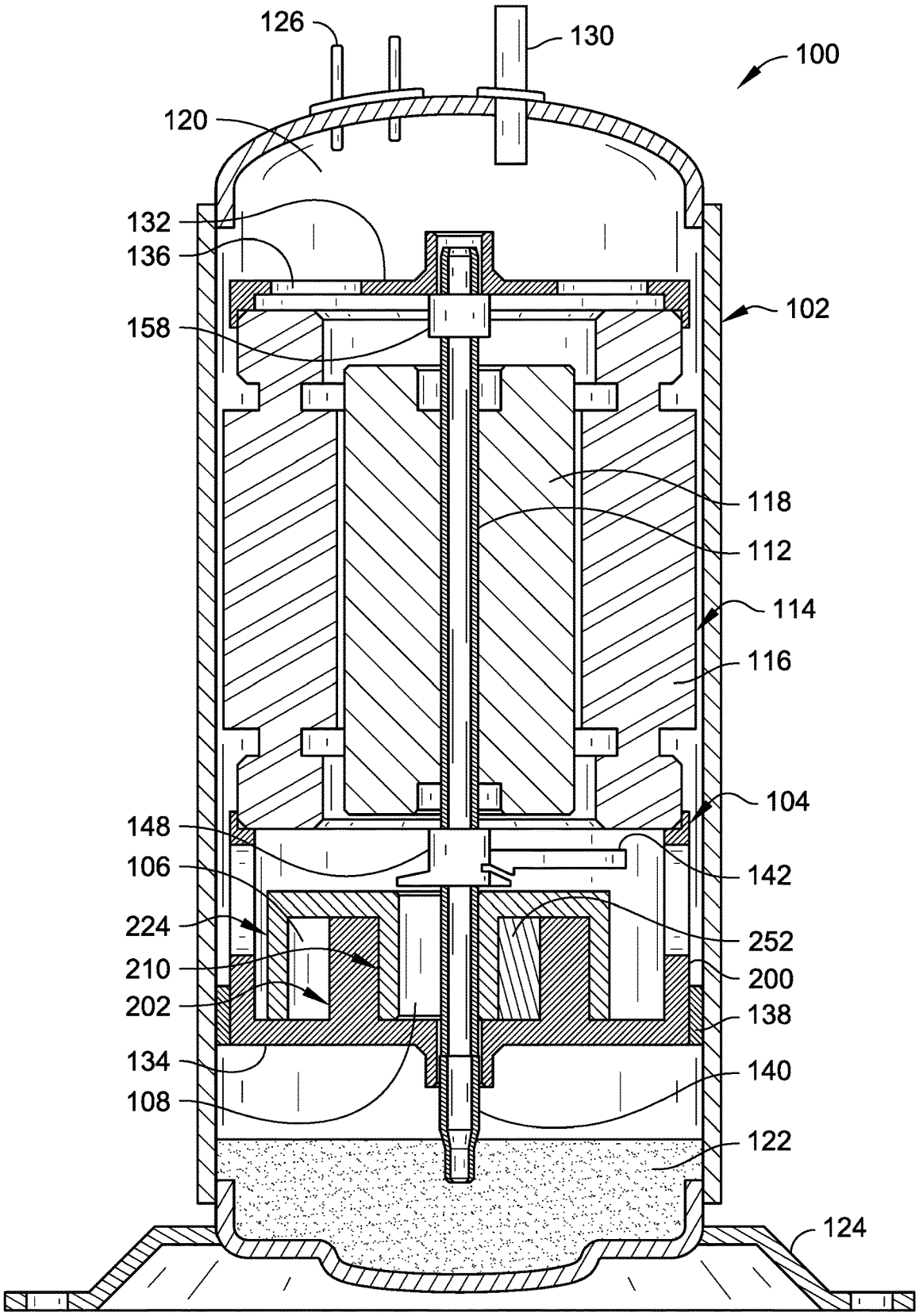
FIG. 2 is a cross-sectional side elevation view illustrating another multistage compressor system with a lower shaft bearing located at the bottom of a compressor and an upper shaft bearing located at the top of a motor in accordance with an example embodiment of the present disclosure.

The alignment posts 146 of the counterweight 142 may be used to maintain the rotational orientation of the counterweight 142 with respect to the thrust bearing 148, the crank 112, and/or other components of the compressor 104, such as an eccentrically orbiting cylinder. In some embodiments, the alignment posts 146 may be configured as metal pins cast with the counterweight 142 (e.g., as a unitary part). In other embodiments, the alignment posts 146 can be separate parts connected to the counterweight body. The thrust bearing 148 can be used to control axial movement of the compressor components (e.g., axial movement of an eccentrically orbiting cylinder). In some embodiments, the thrust bearing 148 includes an eccentric bearing 152, a front shaft bearing 154, and a rear shaft bearing 156. With reference to FIG. 2, a compressor system 100 may also include an upper thrust bearing 158.

Figure 3:
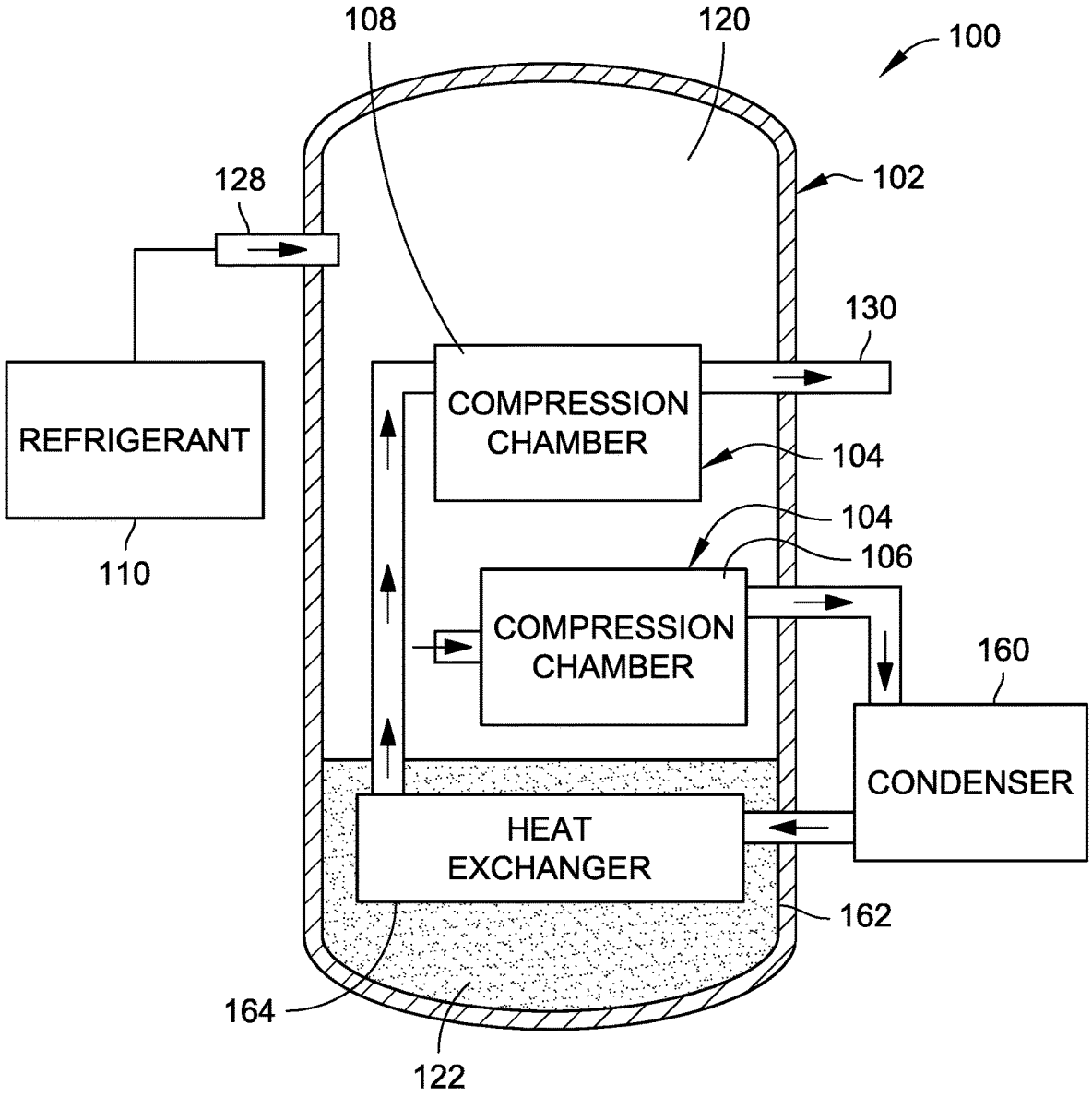
FIG. 3 is a schematic cross-sectional side elevation view illustrating a low pressure compressor crankcase system in accordance with an example embodiment of the present disclosure.
Figure 4:
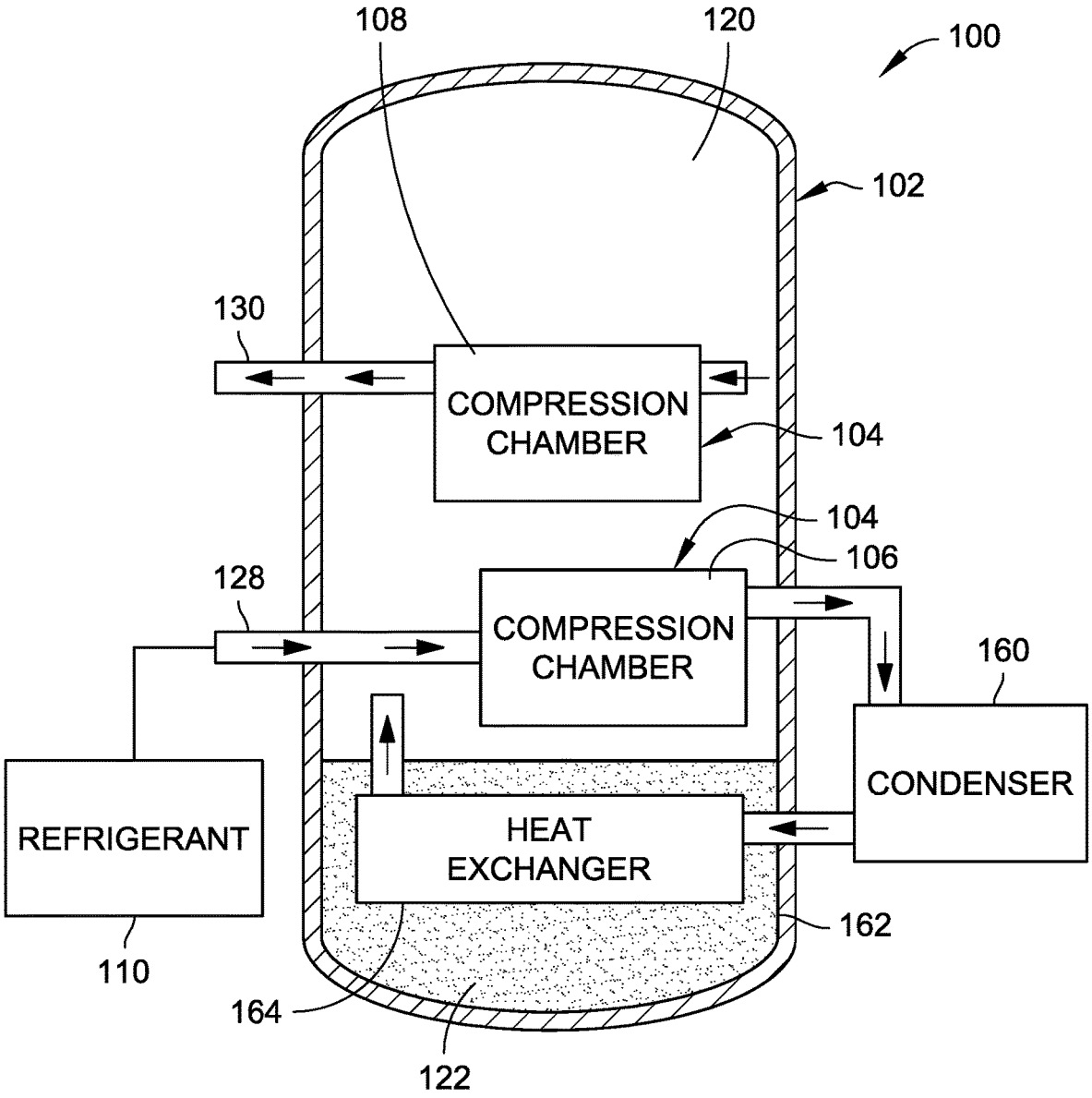
FIG. 4 is a schematic cross-sectional side elevation view illustrating an intermediate pressure compressor crankcase system in accordance with an example embodiment of the present disclosure.
Figure 5:
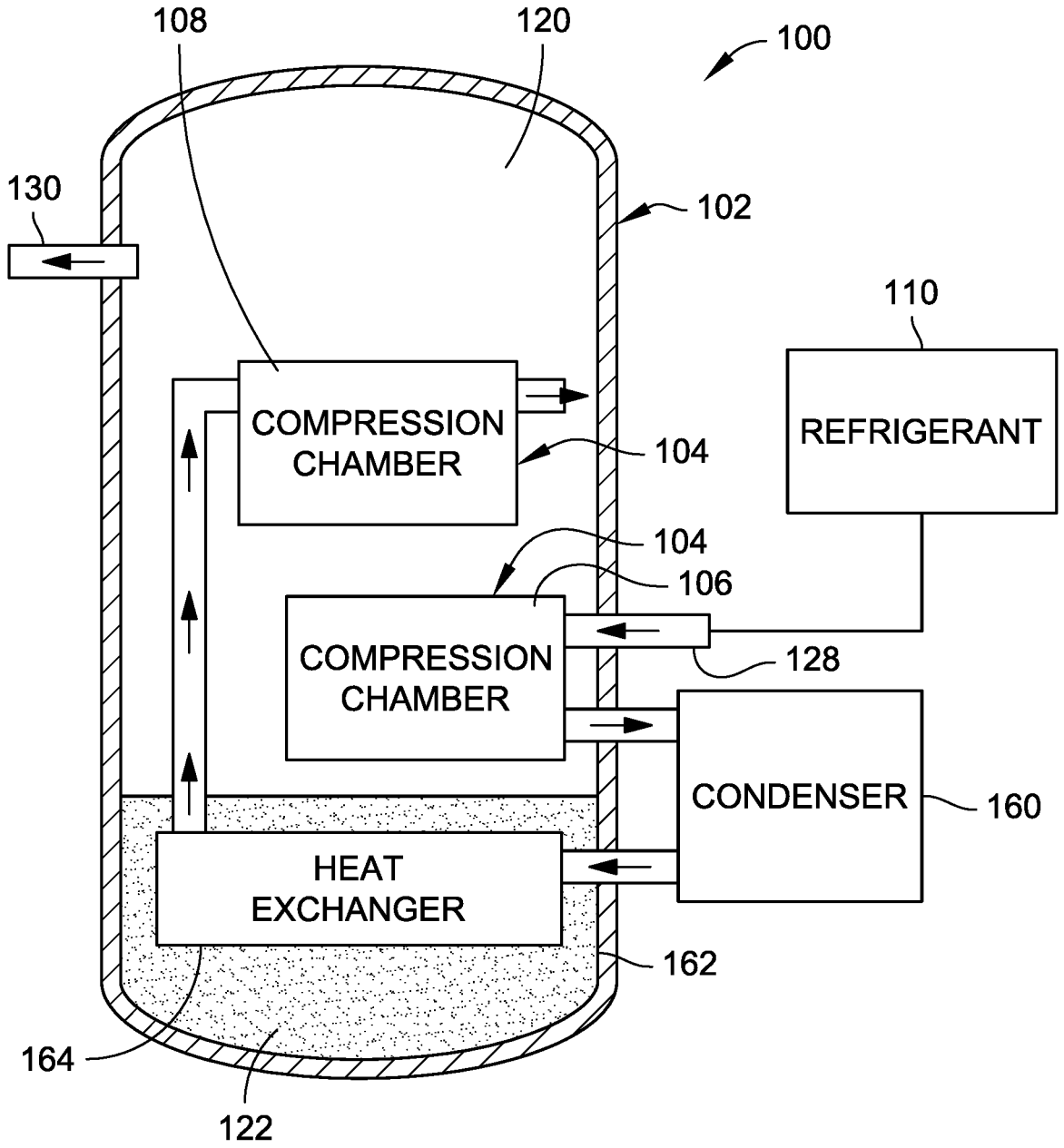
FIG. 5 is a schematic cross-sectional side elevation view illustrating a high pressure compressor crankcase system in accordance with an example embodiment of the present disclosure.
Figure 6:
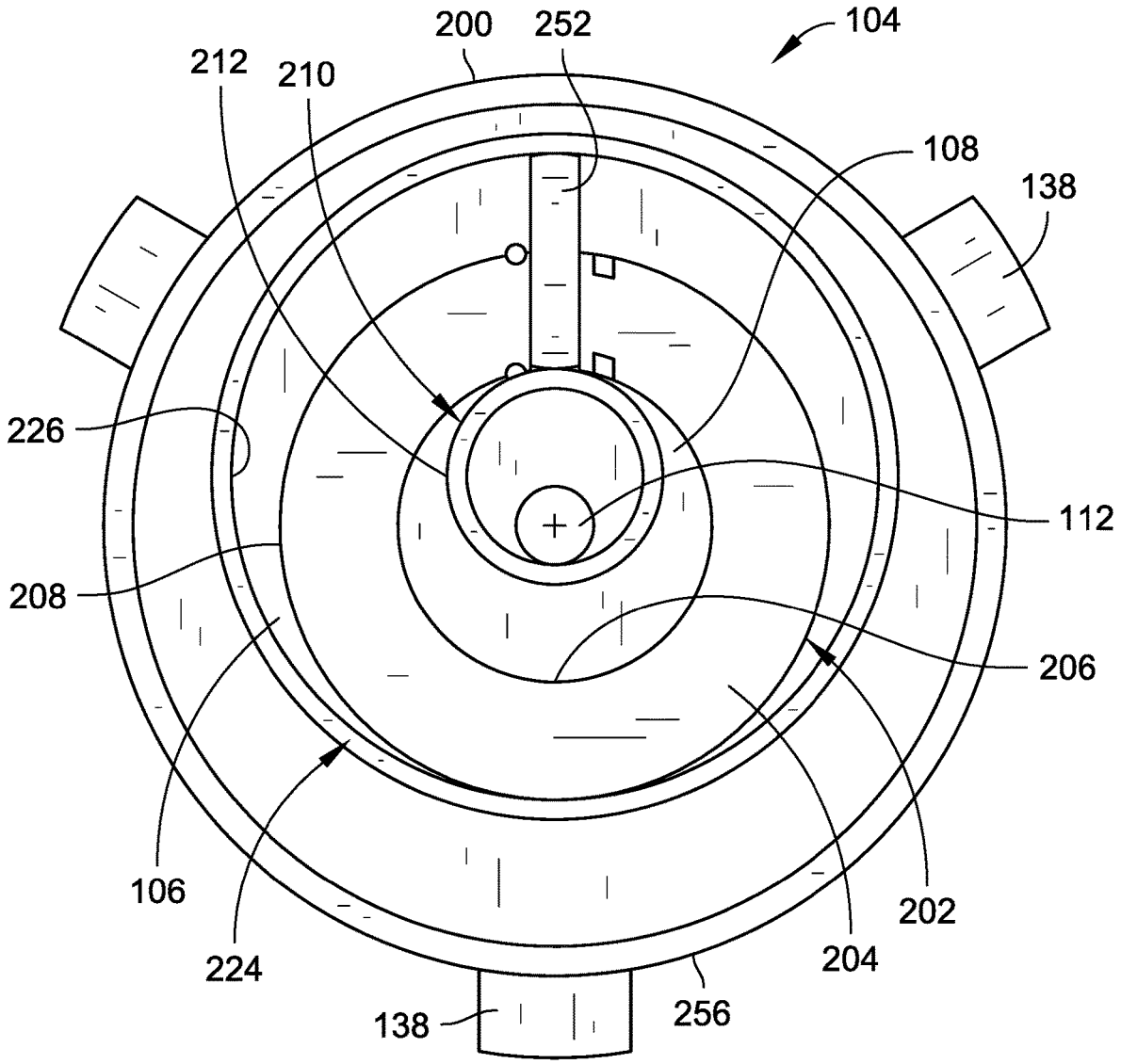
FIG. 6 is a partial top plan view illustrating a concentric vane compressor for a compressor system, such as the compressor systems shown in FIGS. 1 through 5, in accordance with an example embodiment of the present disclosure.

Referring now to FIGS. 3 through 5, in embodiments the compressor 104 includes a heat exchanger (e.g., a condenser 160) outside of the sealed housing 102 configured to release and/or collect heat energy. The condenser 160 is configured to receive refrigerant 110 from the first compressor stage 106 and exchange heat with the refrigerant 110. For example, the condenser 160 allows heat to pass from the refrigerant 110 to fluid outside of the condenser 160, such as outside air, without the refrigerant 110 contacting the outside air or other fluid outside of the condenser 160. In some embodiments, the condenser 160 includes coils (e.g., copper tubing, aluminum tubing), which may have fins for facilitating heat transfer. As described, the condenser 160 can be used to partially or fully condense discharge gas from the first compressor stage 106 to a sub-cooled liquid state prior to entering the second compressor stage 108.

As described, the compressor system 100 also includes an oil reservoir 162 or bottom portion of the interior cavity 120 contained by the sealed housing 102, where the oil 122 is held for lubricating the crank 112 and various components of the compressor system 100. In embodiments of the disclosure, the oil reservoir 162 receives refrigerant 110 from the condenser 160 and exchanges heat with the refrigerant 110 to cool the oil 122 held in the oil reservoir 162. For example, the refrigerant 110 is routed through the oil reservoir 162. The refrigerant 110 is then supplied to the second compressor stage 108. As described, by using a refrigerant cycle to cool the compressor oil 122, the lower oil temperatures and higher thermal transfer rates of the oil 122 can be used to provide a more effective cooling system that makes better use of the oil 122, e.g., for both lubrication and cooling of critical compressor components.

In a typical intercooler arrangement, such as for a two stage refrigeration compressor, compressed gas from a first compressor stage discharge port is routed through a heat exchanger to cool the gas prior to the gas entering the intake port of a second compressor stage. However, the temperature reduction in this arrangement is limited to prevent a phase change of the refrigerant (i.e., from a gas state to a liquid state) prior to the refrigerant entering the second compressor stage. This limit on the temperature reduction is used to avoid the phenomenon of "liquid slugging," or liquid entering a cylinder of a reciprocating compressor and damaging the compressor.

As described herein, when the heat exchanger/condenser 160 receives refrigerant 110 from the first compressor stage 106 and exchanges heat with the refrigerant 110, some or all the refrigerant 110 can be converted to liquid. By then routing the liquid refrigerant 110 through the oil reservoir 162, hot crankcase compressor oil 122 can be used to convert the liquid refrigerant 110 to gas refrigerant 110 while reducing the temperature of the compressor oil 122. The cooled compressor oil 122 can be routed through the compressor crankcase, cooling compressor surfaces, the compressor motor, and/or the gas refrigerant 110, e.g., prior to the gas refrigerant 110 entering the second compressor stage 108.

In some embodiments, the compressor system 100 includes a second heat exchanger 164 in the oil reservoir 162 or bottom portion of the interior cavity 120 contained by the sealed housing 102. The heat exchanger 164 allows heat to pass from the oil 122 to the refrigerant 110 without the oil 122 contacting the refrigerant 110. For example, the second heat exchanger 164 may also include coils (e.g., copper tubing, aluminum tubing), which may have fins for facilitating heat transfer. In some embodiments, the coils may surround the compressor 104 (e.g., in a sump-type compressor configuration). However, it should be noted that in some embodiments, rather than routing all the refrigerant 110 through a second heat exchanger, some or all the liquid refrigerant 110 may bypass the oil heat exchanger 164 and be routed directly onto critical compressor components. In embodiments, some of the incoming cool liquid refrigerant 110 from the condenser 160 may be directed onto critical compressor components, while the remaining cool liquid refrigerant 110 may be used to cool the oil 122 (e.g., using the oil 122 for both lubrication and cooling).

It is noted that temperature reduction during a compression process generally has a positive effect on compressor efficiency, increasing the efficacy of the apparatus, systems, and techniques of the present disclosure. It is also noted that the energy transfer needed to cause a phase change in the refrigerant 110 from gas to liquid or from liquid to gas is many times greater than the energy transfer associated with a temperature change without a corresponding phase change. Thus, the apparatus, systems, and techniques of the present disclosure that use a phase change in the refrigerant 110 can improve compressor cooling and may have a great effect on increasing the efficiency of the compressor systems 100 described herein.

Referring now to FIG. 3, in some embodiments the refrigerant 110 is routed from outside the sealed housing 102 into the interior cavity 120 within the sealed housing 102 and then into the first compressor stage 106 to form a low pressure or suction pressure crankcase. It should be noted that in this configuration, a thrust bearing may be used to maintain axial contact sealing between, for example, stationary cylinder(s) and orbiting cylinder(s) (e.g., of a concentric vane compression device). This configuration may also reduce or eliminate liquid slugging relief.

Referring to FIG. 4, in some embodiments the refrigerant 110 is routed from the oil reservoir 162 into the interior cavity 120 within the sealed housing 102 and then into the second compressor stage 108 to form an intermediate pressure crankcase. This configuration may provide pressure relief for liquid slugging, while allowing minimal axial thrust between stationary cylinder(s) and orbiting cylinder(s) (e.g., of a concentric vane compression device). Further, this arrangement can allow the crankcase pressure to be controlled by the intermediate pressure of the pump, allowing the compressor system 100 to be configurable for a variety of efficiency and wear considerations.

Referring now to FIG. 5, in some embodiments the refrigerant 110 is routed from the second compressor stage 108 into the interior cavity 120 within the sealed housing 102 and then out of the sealed housing 102 to form a high pressure crankcase. This configuration may also provide pressure relief for liquid slugging, and may produce higher axial thrust, possibly increasing axial wear between stationary cylinder(s) and orbiting cylinder(s) (e.g., of a concentric vane compression device), having reduced efficiency when compared to the embodiment illustrated in FIG. 4.

Referring now to FIGS. 6 through 19, a compressor system 100 can be implemented with a positive displacement device that includes both the first compressor stage 106 and the second compressor stage 108, such as a concentric vane compressor 200. As described herein, a positive displacement device configured as a vane compressor can include two orbiting cylinders, rigidly connected at one end by a plate. In embodiments of the disclosure, the inner orbiting cylinder is smaller than the fixed cylinder and the larger orbiting cylinder is larger than the fixed cylinder. In some embodiments, a common vane may pass through a vane slot in the fixed cylinder wall, maintaining sealing contact with both the inner and outer orbiting cylinder surfaces. In this configuration, the smaller orbiting cylinder controls the vane position from one side while the larger orbiting cylinder controls the vane position from the other side.

The concentric vane compressor 200 can provide two compression cavities, each divided into low and high pressure regions. The inner cavity is formed between the inner orbiting cylinder surface and the fixed cylinder surface and has a smaller displaced volume than that of the outer cavity. The outer compression cavity is formed between the fixed cylinder surface and the outer orbiting cylinder surface and has the larger displaced volume. Thus, a concentric vane compressor 200 may be configured as either a single stage compressor or a two stage compressor, e.g., with a single fixed and orbiting cylinder set. For a two stage design, the larger outer cavity may be used for the first stage, and the smaller inner cavity may be used for the second stage.

It should be noted that the outer and inner compression cavities, while sharing a common vane and common orbiting and fixed cylinders, are two separate cavities with compression cycles sequenced one hundred and eighty degrees (180°) apart. This configuration can reduce peak compressor torque (e.g., by about one-half) and/or associated noise and vibration while increasing motor running efficiency. Further, dual concentric sequential compression chambers can support the addition of flow control valves for switching between four levels of mass flow and single stage or two stage compression to increase efficiency (e.g., as weather conditions vary) while also enabling start relief (e.g., for the compressor motor). In embodiments of the disclosure, flow control valves can be located within a compressor enclosure and/or outside of the enclosure. When placed outside of a compressor enclosure, ease of maintenance and/or improved control wiring access may be provided. Additionally, an outside placement can provide for simplified control features and/or upgrade options with a common compressor design. Available features may range from a baseline unit without control valves, two or three additional mass flow levels plus single or two stage compression options, a start relief option, and so on. With outside flow control valves, these options may be available from a manufacturer and/or may be added in the field.

A concentric vane compressor 200 can be used for various applications, including, but not necessarily limited to, pumping fluid and/or gas. For example, a concentric vane compressor 200 can be used as a compressor for refrigeration and/or air conditioning applications, and so forth. The apparatus, systems, and techniques described herein, can provide low cost, low noise, and/or high efficiency oil lubricated rotary compressors that can be used in, for example, refrigeration compressor applications. Using concentric sequential compression, a low clearance volume may be provided. Further, the concentric vane compressor 200 can facilitate start unloading. In some embodiments, a single wrap design allows for a reduced compressor diameter and/or leakage area (e.g., as compared to a multiple wrap design). Further, a concentric vane compressor 200 can provide higher liquid slugging tolerance (e.g., because the orbiting cylinders are not restricted from moving away from the stationary cylinder to relieve pressure spikes). As described herein, this tolerance for liquid slugging can enable a compressor system 100 to achieve a higher degree of temperature reduction (e.g., as compared to the limited temperature reduction available in a typical intercooler, where such temperature reduction is limited to prevent a phase change of the refrigerant prior to the refrigerant entering the second compressor stage).

In embodiments of the disclosure, a concentric vane compressor 200 includes a first cylinder 202 having a wall 204 with an interior surface 206 and an exterior surface 208. The concentric vane compressor 200 also includes a second cylinder 210 disposed within the first cylinder 202. The second cylinder 210 has an exterior surface 212. The interior surface 206 of the first cylinder 202 and the exterior surface 212 of the second cylinder 210 define the second compressor stage 108. The concentric vane compressor 200 also includes a partition between the interior surface 206 of the first cylinder 202 and the exterior surface 212 of the second cylinder 210 to divide the second compressor stage 108 into a first inner region and a second inner region, where a first intake port 220 is in fluid communication with the first inner region of the second compressor stage 108, and a first exhaust port 222 is in fluid communication with the second inner region of the second compressor stage 108.

The concentric vane compressor 200 also includes a third cylinder 224 disposed around the first cylinder 202. The third cylinder 224 has an interior surface 226. The exterior surface 208 of the first cylinder 202 and the interior surface 226 of the third cylinder 224 define the first compressor stage 106. The concentric vane compressor 200 also includes another partition between the exterior surface 208 of the first cylinder 202 and the interior surface 226 of the third cylinder 224 to divide the first compressor stage 106 into a first outer region and a second outer region, where a second intake port 234 is in fluid communication with the first outer region of the first compressor stage 106, and a second exhaust port 236 is in fluid communication with the second outer region of the first compressor stage 106. For the purposes of the present disclosure, the term "third cylinder" shall be defined as any three-dimensional shape having a cylindrical interior surface, and shall encompass the shapes described with reference to the accompanying figures, along with other shapes not described in the accompanying figures. For example, a third cylinder as described herein may be a rectangular prism having a cylindrical interior surface, a hexagonal prism having a cylindrical interior surface, and so on.

The concentric vane compressor 200 includes one sealing interface for sealing first ends of the second compressor stage 108 and the first compressor stage 106, and another sealing interface for sealing second ends of the second compressor stage 108 and the first compressor stage 106. For example, the first cylinder 202 is connected to one end plate 238, and the second and third cylinders 210 and 224 are connected to another end plate 240. In embodiments of the disclosure, the second cylinder 210 and the third cylinder 224 are configured to orbit with respect to the center of the first cylinder 202 to create alternating regions of high pressure and low pressure in the first and second inner regions of the second compressor stage 108 and the first and second outer regions of the first compressor stage 106. For example, the second and third cylinders 210 and 224 and the end plate 240 form a roller that eccentrically orbits the crank 112.

Figure 7:
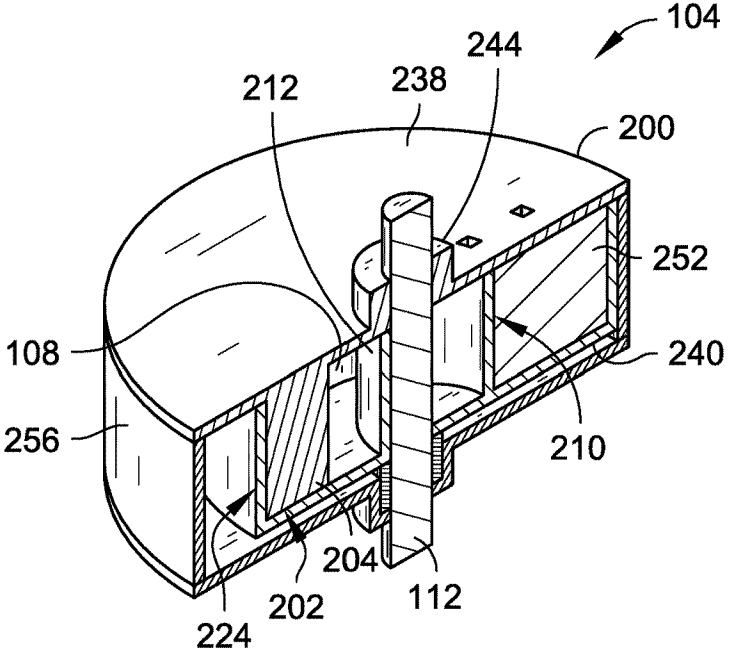
FIG. 7 is a partial cross-sectional isometric view of the concentric vane compressor illustrated in FIG. 6.
Figure 10:
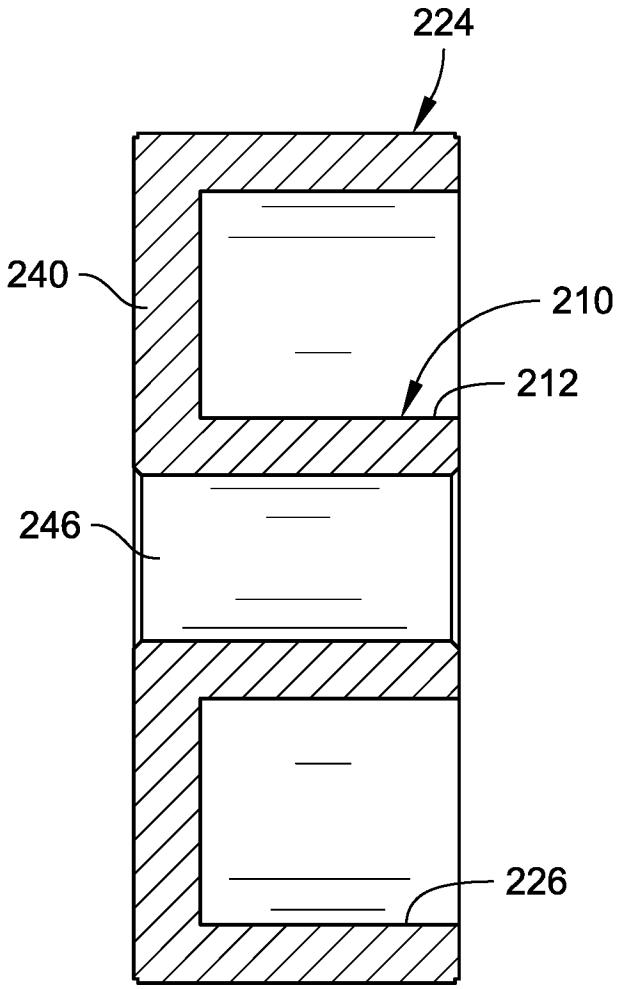
FIG. 10 is a cross-sectional side view of the two cylinders and end plate illustrated in FIG. 9.
Figure 9:
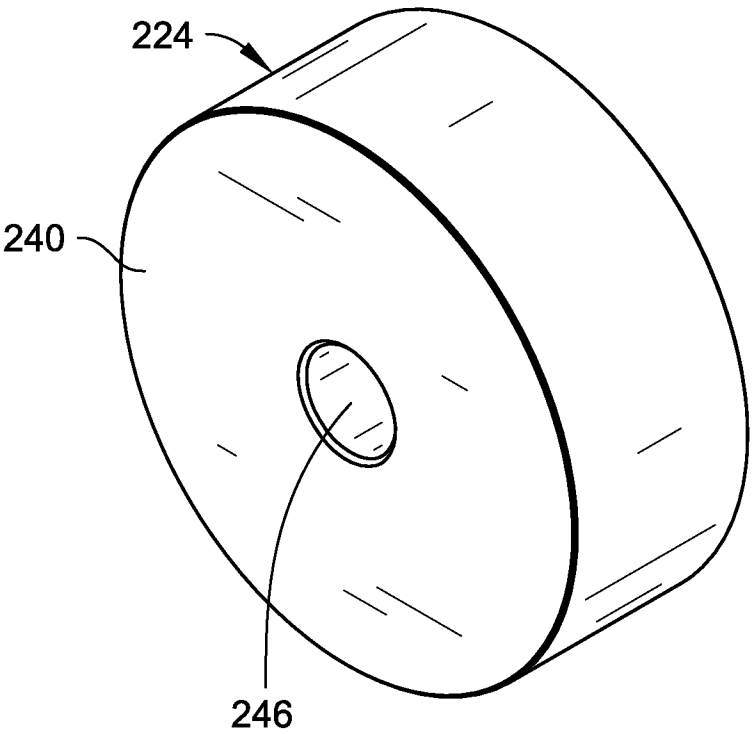
FIG. 9 is an isometric view illustrating two cylinders and an end plate for a concentric vane compressor, such as the concentric vane compressor shown in FIG. 6, in accordance with an example embodiment of the present disclosure.

In some embodiments, a concentric vane compressor 200 can be constructed using a through-shaft design. For example, the crank 112 (e.g., a crankshaft) may extend through the end plates 238 and 240. A drive mechanism, such as a motor, can be used to drive the second and third cylinders 210 and 224 in orbit with respect to the first cylinder 202. Referring to FIG. 7, the end plate 238 can include a journal bearing 244. Referring to FIGS. 9 and 10, the end plate 240 can include an eccentric journal bearing 246. This configuration may facilitate reduced shaft bearing loads and/or shaft deflection (e.g., because a through-shaft design allows the eccentric bearing load to be shared by the two shaft bearings). Furthermore, a reduction of non-symmetric axial thrust between fixed and orbiting pistons can be achieved (e.g., when the eccentric bearing is located in the plane of the orbiting cylinders). In other embodiments, the concentric vane compressor 200 does not necessarily use a through-shaft design. For example, the second cylinder 210 can be connected to an extending shaft that passes through a bearing in the end plate 238.

Figure 16:
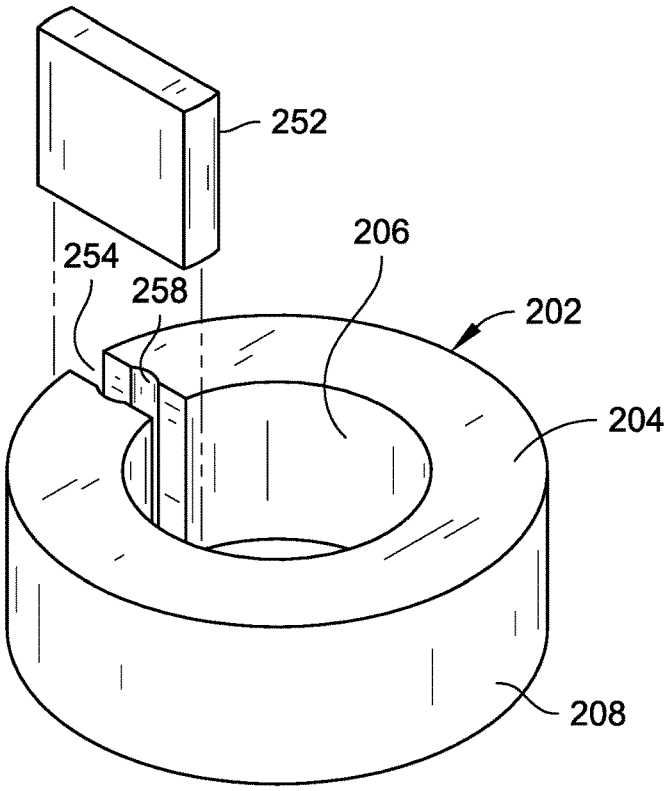
FIG. 16 is an exploded isometric view illustrating a cylinder with a vane slot and a vane for a concentric vane compressor, such as the concentric vane compressor shown in FIG. 6, in accordance with an example embodiment of the present disclosure.

Referring now to FIGS. 10 and 16, in some embodiments the partition between the interior surface 206 of the first cylinder 202 and the exterior surface 212 of the second cylinder 210, and the partition between the exterior surface 208 of the first cylinder 202 and the interior surface 226 of the third cylinder 224, can each be formed by a single vane 252 slidably extending through a vane slot 254 radially formed in the wall 204 of the first cylinder 202. The vane 252 is in sealing contact with the wall 204 of the first cylinder 202, the exterior surface 212 of the second cylinder 210, and the interior surface 226 of the third cylinder 224. The vane 252 provides a barrier between the high and low pressure regions. For example, in some embodiments, the second and third cylinders 210 and 224 can rotate randomly (e.g., allowing for even wear between the mating surfaces, heat distribution, etc.). In other embodiments, an anti-rotation device can be used to prevent or minimize rotation of the second and third cylinders 210 and 224 as the cylinders orbit the center of the first cylinder 202. In some embodiments, a separate vane can be included to form each partition (e.g., each using a vane spring and/or another biasing mechanism to maintain contact with the interior and/or exterior surfaces of the cylinders).

Figure 8:
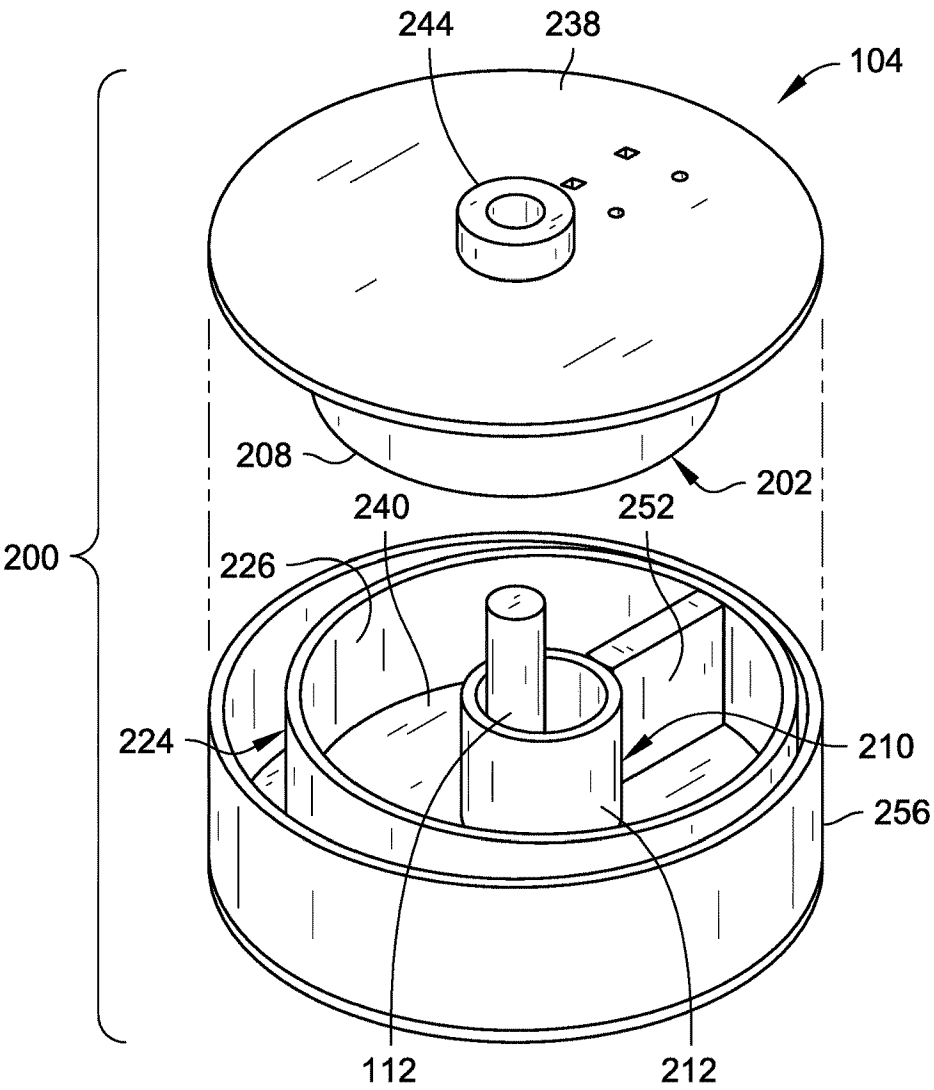
FIG. 8 is a partial exploded isometric view of the concentric vane compressor illustrated in FIG. 6.
Figure 11:
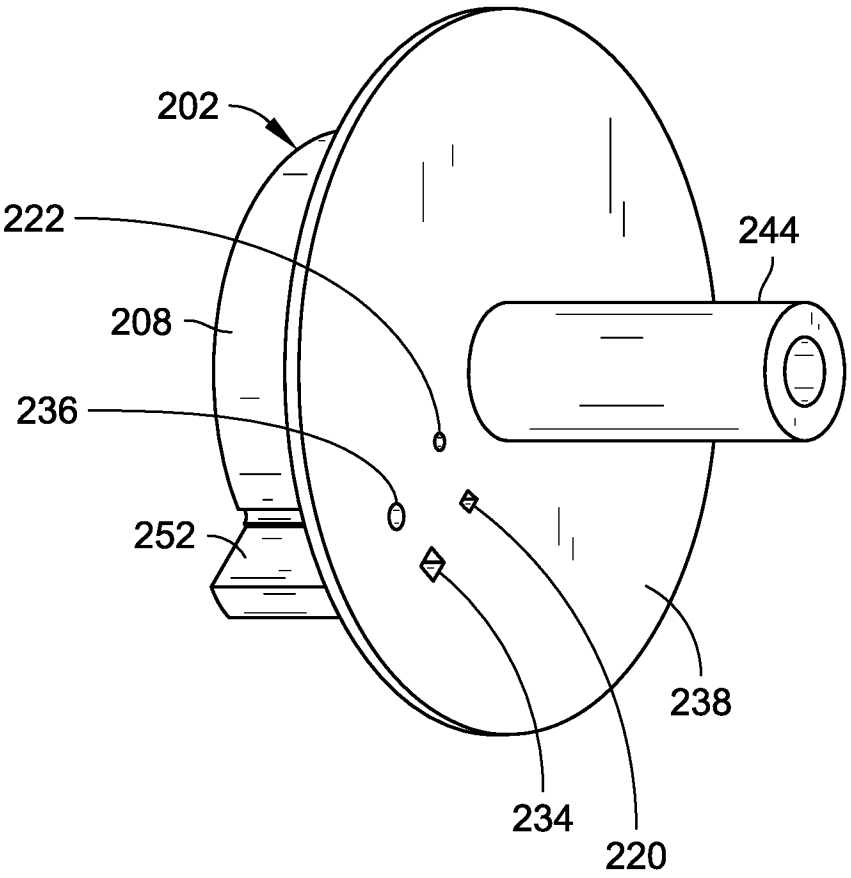
FIG. 11 is an isometric view illustrating a cylinder and an end plate with a journal bearing, two intake ports, and two exhaust ports for a concentric vane compressor, such as the concentric vane compressor shown in FIG. 6, in accordance with an example embodiment of the present disclosure.

Referring now to FIGS. 8 and 11, in some embodiments the first and second intake ports 220 and 234 are provided for supplying a fluid or gas to the concentric vane compressor 200, while the first and second exhaust ports 222 and 236 are provided for supplying the fluid or gas from the concentric vane compressor 200. In some embodiments, the first cylinder 202, the second cylinder 210, and the third cylinder 224 can be placed within an outer shell 256, or an outer compressor housing. As the second and third cylinders 210 and 224 orbit the center of the first cylinder 202, pockets of space, or compression cavities, are created adjacent to the first and second intake ports 220 and 234. Fluid or gas enters these compression cavities via the first and second intake ports 220 and 234. As the second and third cylinders 210 and 224 continue to orbit the center of the first cylinder 202, the compression cavities are separated from the first and second intake ports 220 and 234 and migrate toward the first and second exhaust ports 222 and 236. When the compression cavities are adjacent to the first and second exhaust ports 222 and 236, the fluid or gas is supplied from the concentric vane compressor 200. For instance, compressed gas may be supplied to a storage tank, or the like.

It should be noted that while two second and third cylinders 210 and 224 are illustrated in the accompanying figures, more or fewer cylinders may be included with a concentric vane compressor 200. For example, the third cylinder 224 may be replaced with a compression spring and/or another biasing mechanism for biasing the vane 252 against the first cylinder 202. Further, additional cylinders and/or additional vanes may be included to create additional compression chambers.

In embodiments of the disclosure, surfaces on both the second and third cylinders 210 and 224, and the first cylinder 202, are circular in cross-section, or formed by constant radii. Because the vane 252 inserted between the second and third cylinders 210 and 224 is a separate part, the constant radius compression cavity surfaces on the second and third cylinders 210 and 224, and the first cylinder 202, can be machined using conventional turning processes, which may be performed with greater accuracy and/or at a comparatively lower cost (e.g., when compared to a non-constant radius configuration).

Figure 12:
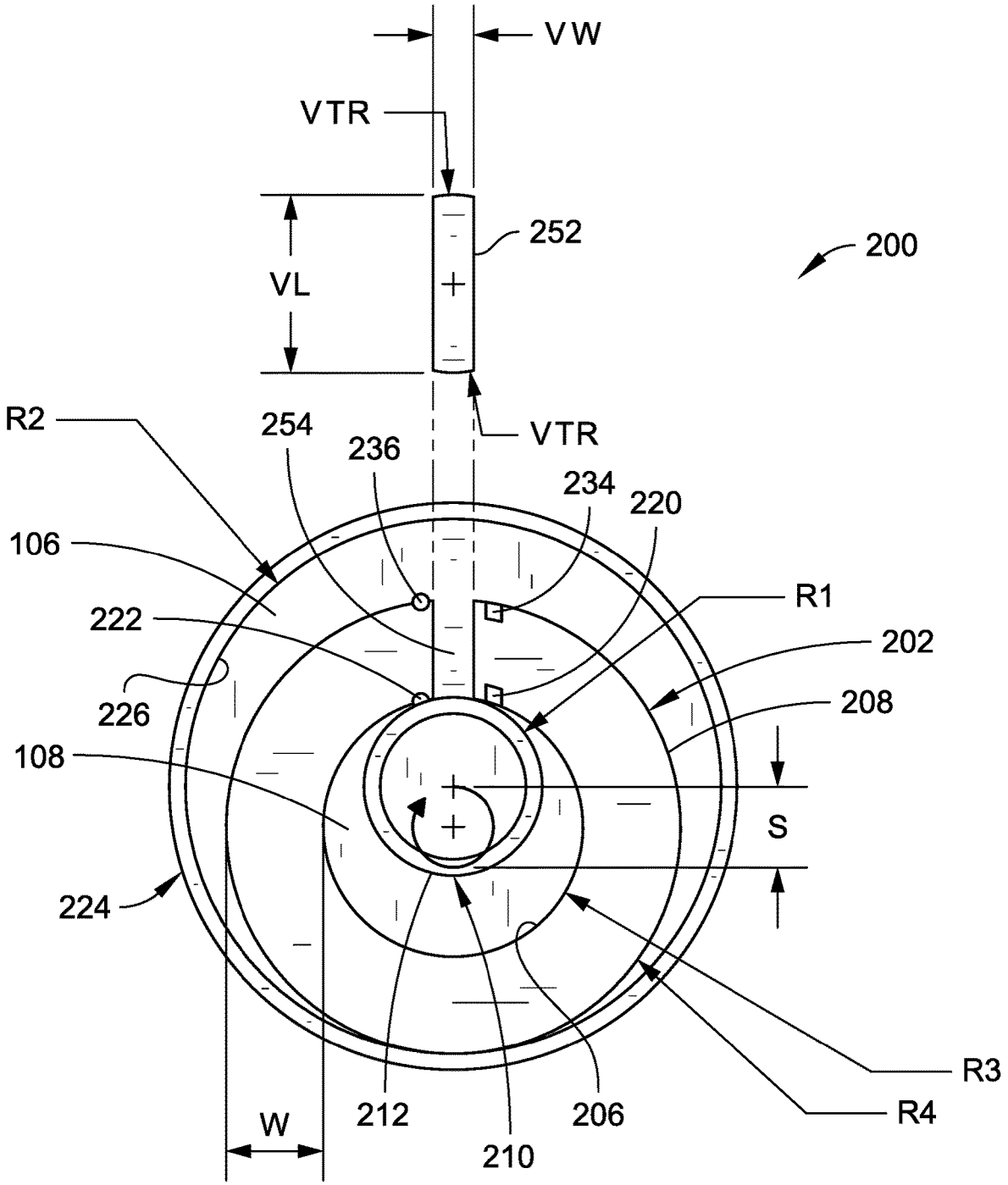
FIG. 12 is another partial top plan view of the concentric vane compressor illustrated in FIG. 6.

Referring now to FIG. 12, in some embodiments, a series of mathematical equations can be used to define the relationships between the geometry of the first cylinder 202, the second and third cylinders 210 and 224, and four defining radii. These relationships may provide a continuous seal in the compression cavities. For the following discussion, S is equal to the stroke, or the travel distance of the second and third cylinders 210 and/or 224 in a straight line (e.g., twice the crankshaft eccentricity). W is equal to the thickness of the wall 204 of the first cylinder 202. R1 is equal to the outside radius of the exterior surface 212 of the second cylinder 210, or the radius of the compression surface of the second cylinder 210. This radius may be selected based upon space requirements. For example, if the central region of the second cylinder 210 is enlarged to pass the crank 112 through, the outside radius R1 of the second cylinder 210 may be determined by space requirements for the compressor shaft, eccentric, and eccentric bearing, plus a minimum wall thickness for the second cylinder 210.

R2, which is equal to the inside radius of the interior surface 226 of the third cylinder 224, or the radius of the compression surface of the third cylinder 224, can then be determined as follows:

$$R2=R1+S+W$$

R3, which is equal to the inside radius of the interior surface 206 of the first cylinder 202, or the radius of the inside compression surface of the first cylinder 202, can be determined as follows:

$$R3=R1+S/2$$

R4, which is equal to the outside radius of the exterior surface 208 of the first cylinder 202, or the radius of the outer compression surface of the first cylinder 202, can be determined as follows:

$$R4=R3+W$$

In embodiments of the disclosure, VW, which is equal to the width of the vane 252, can be selected to allow the vane 252 to travel radially through the first cylinder 202, while providing minimum clearance for gas sealing purposes. The width of the vane 252 may be selected based upon space requirements, and the width of the vane slot 254 in the first cylinder 202 may be equal to the vane width VW plus a desired seal clearance. It should be noted that a comparatively small vane width VW may increase the bending stress on the vane 252 (e.g., due to gas pressure and/or friction between the vane 252 and the second and third cylinders 210 and 224). Further, a vane width VW that permits the second and third cylinders 210 and 224 to contact the edge of the vane 252 may cause a loss of vane seal and/or excessive wear between the vane 252 and the orbiting surfaces the second and third cylinders 210 and 224. Thus, the width of the vane 252 can be selected to be greater than at least a minimum vane width. For instance, $VW_m$, which is Equal to this Minimum vane width, can be determined as follows:

$$VW_m=S*(R2-R1)/(R2+R1)$$

VL, which is equal to the length of the vane 252, or the distance between the two outer ends of the vane, can be determined as follows:

$$VL=R2-R1$$

In embodiments of the disclosure, the vane 252 includes a tip radius, or a radius at the two outer ends of the vane. VTR, which is equal to this vane tip radius, can be determined as follows:

$$VTR=VL/2$$

It should be noted that the concentric vane compressor 200 may include other dimensional relationships and that the dimensional relationships heretofore described are provided by way of example only and not meant to limit the present disclosure. Thus, the concentric vane compressor 200 of the present invention is not necessarily limited to these dimensional relationships. Additionally, for the purposes of the present disclosure, the term "equal to" shall be understood to mean equal to within the limits of precision machinability.

Because the surfaces on the second and third cylinders 210 and 224 are circular, rotational orientation of the second and third cylinders 210 and 224 is not necessarily required. Thus, the need for an external anti-rotation device may be eliminated, allowing the second and third cylinders 210 and 224 to freely rotate while orbiting the center of the first cylinder 202. A cost savings may be achieved by eliminating the anti-rotation device. Additionally, wear on the surfaces of the second and third cylinders 210 and 224, which may be caused by the vane 252, the first cylinder 202, and/or the shell 256, can be uniformly distributed over the entire mating surfaces (e.g., rather than being concentrated in a small region). Additionally, free rotation of the second and third cylinders 210 and 224 can uniformly distribute the heat of gas compression over the entire mating surfaces (e.g., again, rather than being concentrated in a small region). The apparatus, systems, and techniques described herein can provide a reduced peak wear rate and/or uniformity of temperature over the second and third cylinders 210 and 224, and reduction of temperatures in the high pressure region, resulting in less part distortion, lower gas temperatures, and so forth.

It should be noted that while the compression cavities created by the inner and outer second and third cylinders 210 and 224 may share a common vane 252, they can act as separate compression chambers, sequenced one hundred and eighty degrees (180°) apart. The apparatus, systems, and techniques described herein can reduce peak torque for single stage compressors, and may provide a two stage compressor design using the second and third cylinders 210 and 224. For a two stage design, the larger outer cavity can be used for the first stage, and the smaller inner cavity can be used for the second stage. For example, in some embodiments, the first intake port 220 can be connected to (e.g., in fluid communication with) the second exhaust port 236 to form a two stage compressor.

It is noted that a large contributor to vane wear in typical stationary vane compressors is the pressure differential across the vane. Since these are predominantly single stage compressors, the maximum pressure differential across the vane is the discharge pressure minus the suction pressure. In the two stage version of the concentric vane compressor 200 described herein, the intermediate pressure is between the suction pressure and the discharge pressures. The differential pressure across the first stage end of the vane is the intermediate pressure minus the suction pressure. The differential pressure across the second stage end of the vane is the discharge pressure minus the intermediate pressure. Both of these differential pressures and resulting vane forces may be significantly lower than those of a typical stationary vane compressor. Thus, the resulting vane wear of a concentric vane compressor 200 may be comparatively lower than that of a typical stationary vane compressor.

As described herein, the center region of a concentric vane compressor 200 can be enlarged, moving the discharge port and compression cavities radially outward, without increasing the dead space adjacent to the discharge port at the end of the compression cycle. This configuration may yield a high compression ratio design. Enlarging the central region can be done to allow room for an eccentric, an eccentric bearing, a shaft, and shaft bearings, with the shaft passing through the eccentric and supported by shaft bearings on each side of the eccentric. This can reduce the radial forces on the shaft bearings, allowing the use of smaller bearings and/or shafting. Additionally, the eccentric can be located axially within the plane of the second and third cylinders 210 and 224 and the first cylinder 202, allowing radial pressure forces between the second and third cylinders 210 and 224 to pass through the plane of the eccentric bearing and reduce non-symmetric axial thrust between the second and third cylinders 210 and 224 and the first cylinder 202.

A concentric vane compressor 200 may have one or both the second and third cylinders 210 and 224 and/or the first cylinder 202 coated with an abradable coating of enough thickness to cause interference at all sealing surfaces between the members. During the manufacturing or assembly sequence, the second and third cylinders 210 and 224, and the first cylinder 202, can be assembled and operated, causing the excess coating to abrade away leaving a near perfect match between the surfaces of the second and third cylinders 210 and 224 and the first cylinder 202. This process may reduce the need for precise machining.

Figure 17:
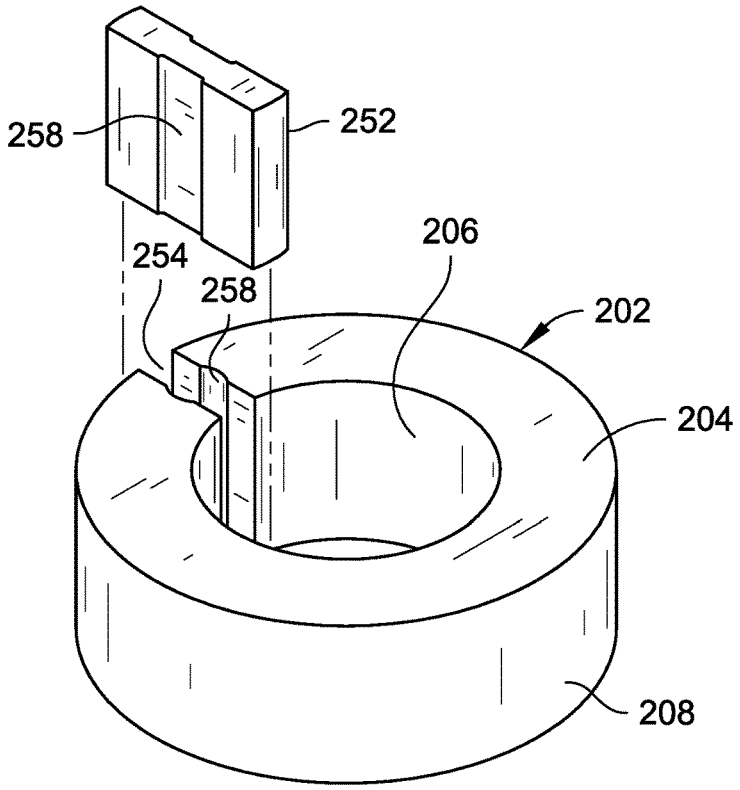
FIG. 17 is an exploded isometric view illustrating another cylinder with a vane slot and a vane for a concentric vane compressor, such as the concentric vane compressor shown in FIG. 6, in accordance with an example embodiment of the present disclosure.
Figure 18:
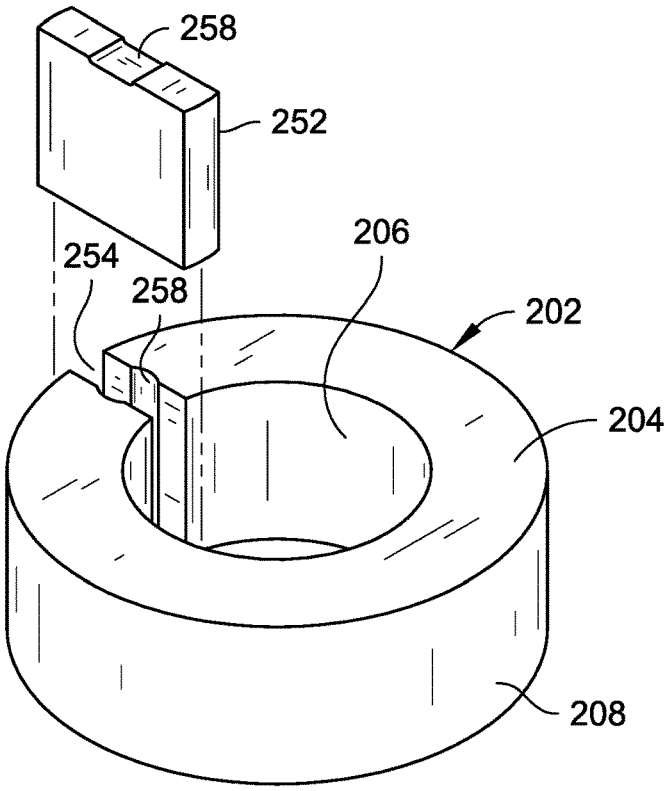
FIG. 18 is an exploded isometric view illustrating a further cylinder with a vane slot and a vane for a concentric vane compressor, such as the concentric vane compressor shown in FIG. 6, in accordance with an example embodiment of the present disclosure.
Figure 19:
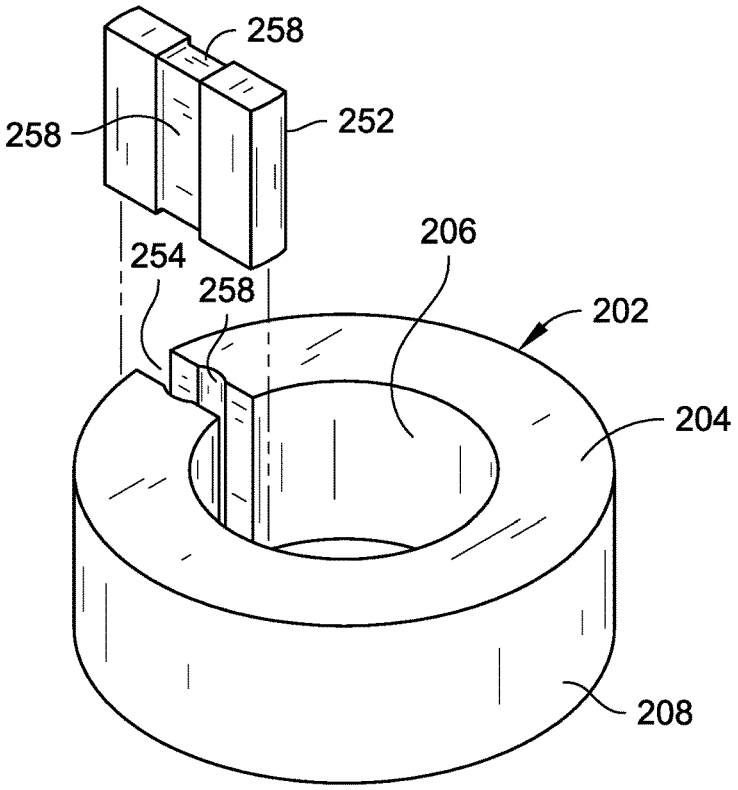
FIG. 19 is an exploded isometric view illustrating another cylinder with a vane slot and a vane for a concentric vane compressor, such as the concentric vane compressor shown in FIG. 6, in accordance with an example embodiment of the present disclosure.

Referring now to FIGS. 16 through 19, in some embodiments the first cylinder 202 and/or the vane 252 may include slots or channels 258 to facilitate lubrication of the vane 252. For example, semicircular channels 258 may be provided on one or both sides of the vane slot 254 of the first cylinder 202 (e.g., as shown in FIGS. 16 through 19). Additionally, slots or channels 258 may be provided in the vane 252 (e.g., as shown in FIGS. 17 through 19). In some embodiments, one or more channels 258 may be provided on a side or sides of the vane 252 (e.g., proximate to the channels 258 defined at the vane slot 254), as shown in FIG. 17. In some embodiments, one or more channels 258 may be provided on a top and/or bottom surface of the vane 252 (e.g., between the channels 258 defined at the vane slot 254), as shown in FIG. 18.

It should be noted that other components of a compressor system 100 may also include slots or channels to facilitate both lubrication and cooling of various components, including, but not necessarily limited to, bearing surfaces of the vane 252, the vane slot 254, radial bearings, and thrust bearings. For example, oil flow paths can be provided through and/or around the crank 112, first bearing 132, second bearing 134, thrust bearing 148, eccentric bearing 152, front shaft bearing 154, rear shaft bearing 156, upper thrust bearing 158, and so forth. Further, the flow paths and/or flow areas for the oil 122 can be adjusted to keep various components at temperatures more consistent with adjacent or proximal components. For example, flow areas around the vane 252 can be configured to keep the vane 252 at a temperature close to that of the first cylinder 202, the second cylinder 210, and/or the third cylinder 224.

Further, in some embodiments, one or more channels 258 may be provided on a side or sides of the vane 252 (e.g., proximate to the channels 258 defined at the vane slot 254) and on a top and/or bottom surface of the vane 252 (e.g., between the channels 258 defined at the vane slot 254), as shown in FIG. 19. As described, the oil 122 may flow upwardly from the shaft oil pump 140 (e.g., through a channel 258 on one side of the vane slot 254 and/or a channel 258 on one side of the vane 252), horizontally across a top and/or bottom surface of the vane 252 (e.g., through a channel 258 in a top surface of the vane 252), and then downwardly into the oil sump (e.g., through a channel 258 on an opposite side of the vane slot 254 and/or a channel 258 on an opposite side of the vane 252).

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A positive displacement device comprising:

a first cylinder having a wall with an interior surface and an exterior surface;

a vane slidably extending through the wall of the first cylinder, at least one of the wall of the first cylinder proximate to the vane and the vane defining a channel to facilitate lubrication of the vane;

a second cylinder disposed within the first cylinder, the second cylinder having an exterior surface, the interior surface of the first cylinder and the exterior surface of the second cylinder defining an inner cavity therebetween, the vane moveable with respect to the second cylinder and in sealing contact between the interior surface of the first cylinder and the exterior surface of the second cylinder to divide the inner cavity into a first inner region and a second inner region;

a first intake port in fluid communication with the first inner region of the inner cavity;

a first exhaust port in fluid communication with the second inner region of the inner cavity;

a third cylinder disposed around the first cylinder, the third cylinder having an interior surface, the exterior surface of the first cylinder and the interior surface of the third cylinder defining an outer cavity therebetween, the vane moveable with respect to the third cylinder and in sealing contact between the exterior surface of the first cylinder and the interior surface of the third cylinder to divide the outer cavity into a first outer region and a second outer region;

a second intake port in fluid communication with the first outer region of the outer cavity;

a second exhaust port in fluid communication with the second outer region of the outer cavity;

a first sealing interface for sealing first ends of the inner cavity and the outer cavity; and a second sealing interface for sealing second ends of the inner cavity and the outer cavity, wherein the second cylinder and the third cylinder are configured to orbit with respect to the first cylinder to create alternating regions of high pressure and low pressure in the first and second inner regions of the inner cavity and the first and second outer regions of the outer cavity.

2. The positive displacement device as recited in claim 1, further comprising:

a sealed housing, the outer cavity for receiving refrigerant from outside of the sealed housing and compressing the refrigerant, and the inner cavity for receiving refrigerant from within the sealed housing and compressing the refrigerant;

a crank for mechanically driving both the second cylinder and the third cylinder;

a heat exchanger outside of the sealed housing, the heat exchanger for receiving refrigerant from the outer cavity and exchanging heat with the refrigerant; and an oil reservoir contained by the sealed housing, the oil reservoir including oil for lubricating the crank, the oil reservoir for receiving the refrigerant from the heat exchanger and exchanging heat with the refrigerant to cool the oil in the oil reservoir, the refrigerant supplied to the inner cavity.

3. The positive displacement device as recited in claim 2, further comprising a second heat exchanger in the oil reservoir for receiving the refrigerant from the heat exchanger and exchanging heat with the refrigerant to cool the oil in the oil reservoir.

4. The positive displacement device as recited in claim 2, wherein refrigerant is routed from outside the sealed housing into an interior cavity within the sealed housing and then into the outer cavity to form a low pressure crankcase.

5. The positive displacement device as recited in claim 2, wherein refrigerant is routed from the oil reservoir into an interior cavity within the sealed housing and then into the inner cavity to form an intermediate pressure crankcase.

6. The positive displacement device as recited in claim 2, wherein refrigerant is routed from the inner cavity into an interior cavity within the sealed housing and then out of the sealed housing to form a high pressure crankcase.

7. The positive displacement device as recited in claim 1, further comprising an end plate for connecting the second cylinder and the third cylinder together, wherein the end plate forms one of the first sealing interface or the second sealing interface.

8. The positive displacement device as recited in claim 7, further comprising a second end plate connected to the first cylinder, wherein the second end plate forms the other of the first sealing interface or the second sealing interface.

9. A positive displacement device comprising:

a first cylinder having a wall with an interior surface and an exterior surface;

a vane slidably extending through the wall of the first cylinder, at least one of the wall of the first cylinder proximate to the vane and the vane defining a channel to facilitate lubrication of the vane;

a second cylinder disposed within the first cylinder, the second cylinder having an exterior surface, the interior surface of the first cylinder and the exterior surface of the second cylinder defining an inner cavity therebetween, the vane moveable with respect to the second cylinder and in sealing contact between the interior surface of the first cylinder and the exterior surface of the second cylinder to divide the inner cavity into a first inner region and a second inner region;

a first intake port in fluid communication with the first inner region of the inner cavity;

a first exhaust port in fluid communication with the second inner region of the inner cavity;

a third cylinder disposed around the first cylinder, the third cylinder having an interior surface, the exterior surface of the first cylinder and the interior surface of the third cylinder defining an outer cavity therebetween, the vane moveable with respect to the third cylinder and in sealing contact between the exterior surface of the first cylinder and the interior surface of the third cylinder to divide the outer cavity into a first outer region and a second outer region;

a second intake port in fluid communication with the first outer region of the outer cavity;

a second exhaust port in fluid communication with the second outer region of the outer cavity;

a first sealing interface for sealing first ends of the inner cavity and the outer cavity;

a second sealing interface for sealing second ends of the inner cavity and the outer cavity, wherein the second cylinder and the third cylinder are configured to orbit with respect to the first cylinder to create alternating regions of high pressure and low pressure in the first and second inner regions of the inner cavity and the first and second outer regions of the outer cavity; and an end plate for connecting the second cylinder and the third cylinder together, the end plate forming one of the first sealing interface or the second sealing interface.

10. The positive displacement device as recited in claim 9, further comprising:

a sealed housing, the outer cavity for receiving refrigerant from outside of the sealed housing and compressing the refrigerant, and the inner cavity for receiving refrigerant from within the sealed housing and compressing the refrigerant;

a crank for mechanically driving both the second cylinder and the third cylinder;

a heat exchanger outside of the sealed housing, the heat exchanger for receiving refrigerant from the outer cavity and exchanging heat with the refrigerant; and an oil reservoir contained by the sealed housing, the oil reservoir including oil for lubricating the crank, the oil reservoir for receiving the refrigerant from the heat exchanger and exchanging heat with the refrigerant to cool the oil in the oil reservoir, the refrigerant supplied to the inner cavity.

11. The positive displacement device as recited in claim 10, further comprising a second heat exchanger in the oil reservoir for receiving the refrigerant from the heat exchanger and exchanging heat with the refrigerant to cool the oil in the oil reservoir.

12. The positive displacement device as recited in claim 10, wherein refrigerant is routed from outside the sealed housing into an interior cavity within the sealed housing and then into the outer cavity to form a low pressure crankcase.

13. The positive displacement device as recited in claim 10, wherein refrigerant is routed from the oil reservoir into an interior cavity within the sealed housing and then into the inner cavity to form an intermediate pressure crankcase.

14. The positive displacement device as recited in claim 10, wherein refrigerant is routed from the inner cavity into an interior cavity within the sealed housing and then out of the sealed housing to form a high pressure crankcase.

15. The positive displacement device as recited in claim 9, further comprising a second end plate connected to the first cylinder, wherein the second end plate forms the other of the first sealing interface or the second sealing interface.

16. A positive displacement device comprising:

a first cylinder having a wall with an interior surface and an exterior surface;

a vane slidably extending through the wall of the first cylinder, at least one of the wall of the first cylinder proximate to the vane and the vane defining a channel to facilitate lubrication of the vane;

a second cylinder disposed within the first cylinder, the second cylinder having an exterior surface, the interior surface of the first cylinder and the exterior surface of the second cylinder defining an inner cavity therebetween, the vane moveable with respect to the second cylinder and in sealing contact between the interior surface of the first cylinder and the exterior surface of the second cylinder to divide the inner cavity into a first inner region and a second inner region;

a first intake port in fluid communication with the first inner region of the inner cavity;

a first exhaust port in fluid communication with the second inner region of the inner cavity;

a third cylinder disposed around the first cylinder, the third cylinder having an interior surface, the exterior surface of the first cylinder and the interior surface of the third cylinder defining an outer cavity therebetween, the vane moveable with respect to the third cylinder and in sealing contact between the exterior surface of the first cylinder and the interior surface of the third cylinder to divide the outer cavity into a first outer region and a second outer region;

a second intake port in fluid communication with the first outer region of the outer cavity;

a second exhaust port in fluid communication with the second outer region of the outer cavity;

a first sealing interface for sealing first ends of the inner cavity and the outer cavity;

a second sealing interface for sealing second ends of the inner cavity and the outer cavity, wherein the second cylinder and the third cylinder are configured to orbit with respect to the first cylinder to create alternating regions of high pressure and low pressure in the first and second inner regions of the inner cavity and the first and second outer regions of the outer cavity;

a first end plate for connecting the second cylinder and the third cylinder together, the first end plate forming one of the first sealing interface or the second sealing interface; and a second end plate connected to the first cylinder, the second end plate forming the other of the first sealing interface or the second sealing interface.

17. The positive displacement device as recited in claim 16, further comprising:

a sealed housing, the outer cavity for receiving refrigerant from outside of the sealed housing and compressing the refrigerant, and the inner cavity for receiving refrigerant from within the sealed housing and compressing the refrigerant;

a crank for mechanically driving both the second cylinder and the third cylinder;

a heat exchanger outside of the sealed housing, the heat exchanger for receiving refrigerant from the outer cavity and exchanging heat with the refrigerant;

an oil reservoir contained by the sealed housing, the oil reservoir including oil for lubricating the crank, the oil reservoir for receiving the refrigerant from the heat exchanger and exchanging heat with the refrigerant to cool the oil in the oil reservoir, the refrigerant supplied to the inner cavity; and a second heat exchanger in the oil reservoir for receiving the refrigerant from the heat exchanger and exchanging heat with the refrigerant to cool the oil in the oil reservoir.

18. The positive displacement device as recited in claim 17, wherein refrigerant is routed from outside the sealed housing into an interior cavity within the sealed housing and then into the outer cavity to form a low pressure crankcase.

19. The positive displacement device as recited in claim 17, wherein refrigerant is routed from the oil reservoir into an interior cavity within the sealed housing and then into the inner cavity to form an intermediate pressure crankcase.

20. The positive displacement device as recited in claim 17, wherein refrigerant is routed from the inner cavity into an interior cavity within the sealed housing and then out of the sealed housing to form a high pressure crankcase.

* * * * *